US006081177A

United States Patent [19]

Fausch

[11] Patent Number: 6,081,177

[45] Date of Patent: Jun. 27, 2000

[54] RELAY WITH RESTRICTED GUIDANCE CONTACTS

[75] Inventor: Werner Fausch, Buchs, Switzerland

[73] Assignee: Elestra Relays GmbH, Bad Ragaz, Switzerland

[21] Appl. No.: 09/301,322

[22] Filed: Apr. 29, 1999

[30] Foreign Application Priority Data

Apr. 30, 1998 [EP] European Pat. Off. ..... 98810388

[51] Int. Cl.[7] ..... H01H 67/02

[52] U.S. Cl. ..... 335/129; 335/128

[58] Field of Search ..... 335/78–86, 124, 335/128, 129, 130, 131, 202

[56] References Cited

U.S. PATENT DOCUMENTS

| | | | |
|---|---|---|---|
| 4,618,842 | 10/1986 | Nestlen et al. . | |
| 5,440,285 | 8/1995 | Nakanishi et al. | 335/78 |
| 5,757,255 | 5/1998 | Noda et al. | 335/78 |
| 5,805,040 | 9/1998 | Corcoran | 335/202 |

*Primary Examiner*—Lincoln Donovan

*Attorney, Agent, or Firm*—Burns, Doane, Swecker & Mathis, LLP

[57] ABSTRACT

In a miniaturized relay for explosion endangered regions, the coil, core, and yoke are cast integrally into the carrier part. Restricted guidance contact units are disposed on the carrier part, on both sides of a partition. The armature is disposed on the side of the coil remote from contacts. A comb connects the armature on the one side of the coil body with the contact springs on the other side of the coil body. In the region in which the comb passes by the coil body, a guide for the comb is embodied on the carrier part. The partition has an extension which reaches into this guide region next to the coil. This extension and the rest of the partition are provided with a groove into which a rib on the cap encompassing the relay protrudes in order to elongate the air and leakage path between the contact units on the one side of the partition and the contact units on the other side of the partition. Air and leakage paths of at least 10 mm are maintained between the contacts and the electrically conductive parts of the magnetic circuit. A double insulation is provided between the contacts on the one side of the partition and those on the other.

22 Claims, 7 Drawing Sheets

RELAY WITH RESTRICTED GUIDANCE CONTACTS

BACKGROUND OF THE INVENTION

1. Field of the Invention

The present invention relates to a safety relay with restricted guidance contacts for network voltage and an insulation between the control side and the output side that is sufficient for explosion endangered regions, in particular a print relay, according to the preamble to claim 1.

2. Background Information

There are known dual-contact and multi-contact print relays on the market that are for network voltage and have restricted guidance contacts, in which at least one contact spring pair is disposed on one side and on the other side of a partition, and the insulation between the individual output side contacts is increased or doubled in order to achieve a so-called "safe separation" according to DIN VDE 0106 (DIN VDE German Institute for Standardization, Association of German Electrical Engineers) protection from dangerous body currents). Furthermore, an insulation that fulfills the requirements for electrical equipment for explosion endangered regions according to the standard EN 50020 is provided between the control side and the output side (leakage path on the inside of the relay ≧10 mm, referred to below as EEx insulation). Relays of is kind are known, for example from the 1998 product catalog of the present assignee. In it, they are called SIR 312 or SIR 422, for example. These relays, with 46.4 or 58.9×16×30.7 mm are already relatively small for four-contact or six-contact safety relays. But users continue to demand the smallest relays possible. With increasing miniaturization, however, maintaining the required safety distances is becoming increasingly difficult. In many cases, the guidance of the contact springs in a straight line is forsaken in favor of smaller dimensions and therefore a good and long-lasting adjustment is made more difficult.

Thus, for example, there is a four-contact relay on the market with very small outer dimensions of approx. 36×12.5×29 mm, but without EEx insulation between the control and output sides. Also, the output side plug connectors of different contact pairs have no doubled insulation. With this relay, in order to achieve these small dimensions, the contact springs are each bent twice between the base and the top part. In addition, they are more strongly offset the closer to the coil they are disposed.

U.S. Pat. No. 4,618,842 has disclosed a relay without restricted guidance, which likewise has two change-over contacts on opposite sides of a partition that perpendicularly adjoins the control part. The contact springs of the contact units, which are likewise offset, are moved in one direction by means of a comb which is divided into two arms and is driven by an armature and a magnet coil. Pins are embodied on the arms and engage in rectangular holes in the moved ends of the contact springs. The comb can be introduced in the drive direction, with these pins being inserted into these holes. The partition has an insertion aid, not described in detail, between the two arms of the comb. The insertion aid constitutes a thickening of the partition and is disposed with a sufficient distance from the moved contact spring so that with the insertion of the comb, the pins are aligned before they have to be slid into the holes. The insertion aid therefore has a rounded end, which is disposed on the control side with a greater distance from the moved contact spring than the partition between the control side and the output side is spaced apart from the moved contact spring. The relay has no EEx insulation.

However, there are known change-over contact relays with EEx insulation between the control side and the output side, which have this small size, in particular, the one listed in the above-mentioned catalog of the present assignee, under the name SIR 282. In this one, the coil, together with the core and yoke, as well as the base ends of the contact springs, are cast integrally into a carrier part so that the relay is wash-resistant. The armature is disposed on the side of the coil remote from the output side. The three contact springs of a change-over contact unit are disposed very close to one another, wherein the central moved contact spring extends in a straight line through the insulating carrier part and constitutes the plug connector on the outside of the carrier part. The two other contact springs, however, are each offset in the integrally cast region by a good 2.5 mm in order, despite the very close disposition of the contact springs, to maintain a norm-dictated distance of approx. 5 mm between the plug connectors of the contact springs of a change-over contact. The partition between the two change-over contacts is disposed in the region of the moved ends of the contact springs, between two short ribs on the cap. As a result, the air and leakage paths between the one contact spring of a change-over contact and the diagonally opposing contact spring of the other change-over contact are long enough to assure an increased insulation under certain conditions.

For the assembly of this relay, the contact springs must be inserted into a pre-assembled holding part. Then this holding part, which is equipped with contact springs, together with the magnet coil, core, and yoke, can be cast into a single part in an injection molding facility.

Apart from the insufficient properties of the change-over contact relay for corresponding to the current requirements for relays in explosion endangered regions, the offsets of the contact springs are particularly disadvantageous. It is also disadvantageous that the carrier part has to be manufactured by means of two separate casting processes.

SUMMARY OF THE INVENTION

An object of the invention, therefore, is to create a relay with at least two restricted guidance contact units in which a doubled or increased insulation is assured between the contact units of the output side and an EEx insulation is assured between the output side and the control side, and whose outer dimensions are significantly smaller than the outer dimensions of known relays of this type. As a result, the contact springs should be guided in a straight line in order to facilitate an adjustment of the relay.

According to the invention, this object is attained by virtue of the fact that in the safety relay, all contact springs are embodied as flat-planed, the contact springs disposed closest to the control side are disposed with a minimal distance from the coil body sufficient for their adjustment and function, and the part of the partition, which protrudes beyond the coil body on the comb side, reaches over to the control side along the comb side surface of the coil body so that its armature end has a distance from the contact springs disposed closest to the coil body and this distance is greater than the distance between the coil body and the contact springs disposed closest to it, and an air and leakage path is assured between the two contact springs disposed closest to the coil body, which fulfills the requirements for protection against dangerous body currents.

On the comb side, the coil body is insulated anyway because of the above-described insulation between the electrically conductive parts of the control side and the output side by means of the extrusion coating of the magnet coil.

Therefore, with the elongation of the partition toward the armature, an elongation of the air and leakage paths is achieved, which permit the output contacts to come closer to the control unit.

Since the air and leakage path can be elongated sufficiently for a double insulation by means of the partition that is elongated next to the coil body, the contact springs that adjoin the coil body can be disposed with a minimum distance from the coil body, which is required for the adjustment. In order to achieve this reduction of the space between the coil body and the closest contact spring, the relay becomes shorter.

Through the extrusion coating of the magnet coil, the coil and with it, the core and yoke as well, are fixed in a stationary fashion in the carrier part so that the position of the individual parts of the relay and the distances between these are immutably defined.

The contact springs have no significant offsets and thanks to this geometrically flat-planed embodiment, can be better adjusted and are less sensitive to different operating temperatures. Advantageously, the core of the magnet coil is aligned parallel to the contact springs and the magnet coil is shorter than the length of the contact springs. As a result, the diameter of the magnet coil is the dimension that determines the distance between the conductive parts on the output side, and the conductive parts on the control side. The relay is therefore shorter in structure than in a type with a core disposed perpendicular to the alignment of the contact springs.

Advantageously, the carrier part is an injection molded part that is cast as one piece with the extrusion coating of the magnet coil. Since the carrier part is manufactured for the control side and the output side in one work cycle, very few separate parts have to be manipulated and a casting procedure can be eliminated.

Advantageously, the cap or a separate cover part, which is disposed on the outside of the comb, and the partition slide into each other with a rib and a groove over the entire length of the partition on the comb side. As a result, the leakage and air path between the electrically conducting parts of one half and the electrically conducting parts of the other half is elongated in labyrinth fashion around the partition. The cover preferably engages with a rib on the cover in a groove in the partition. The groove in the partition is embodied parallel to the plane of the partition. A separate cover part or the housing or the cap can serve as a cover. Thanks to the labyrinthine extension, the partition does not need to be extended further beyond the movable end of the contact springs than the space that is required anyway for the restricted guidance with the comb.

With the groove and the rib, the air and leakage path can also be elongated by way of the coil body for a double insulation in a very small space.

Advantageously, in the base region of the contact springs, the carrier part has clamping grooves aligned perpendicular to the movement direction of the comb, into which the contact springs can be slid in a direction perpendicular to the partition. Since the contact springs can be slid into the carrier part from the two opposing sides of the relay that run parallel to the partition, they can be precisely fixed in height with simple means. For example a cooperation of a projection in the carrier part and a recess in the contact spring or vice versa is used for this.

In a relay with a number of output contacts in one half, ribs or intermediary walls are advantageously embodied on the carrier part, perpendicular to the partition and between the output contacts in the same half. These ribs or intermediary walls elongate the air and leakage paths between the neighboring contact springs.

In addition, a projection is advantageously embodied on the two opposing sides of the partition and these projections are disposed on the side of the comb remote from the relay. With these projections, the distance of the tips is greater than the width of the incision between the arms of the comb. As a result, after being inserted into the carrier part, the comb engages behind the projections and is nevertheless movable. Between the arms and the incision, at least one spring member is advantageously embodied on the comb and cooperates with the projection. These spring means bend back when the comb is being inserted in detent fashion into the carrier part and thus permit its detent engagement without the arms of the comb running the risk of being deformed.

For the manufacture of the relay according to exemplary embodiments of the invention, a carrier part is manufactured in one piece for the electrically conductive parts of the control side and the output side. In the manufacture of the carrier part, a magnet coil is cast integrally into it. As a result, separate casting processes are no longer necessary for producing the different parts of the carrier part. The coil, together with the core and yoke, is fixed in the plastic mass. As a result, rigid relationships are also produced which are estimated with this kind of precision articles.

Advantageously, the contact springs are slid into a clamping groove in the carrier part from the two opposing sides of the relay that are parallel to a partition. As a result, they can be subsequently mounted and precisely fixed in position.

After this, the comb is advantageously put in place, inserted in detent fashion into a guide, and brought into engagement with the contact springs, and the function of the relay is tested before the placement of the cover or cap. As a result, the relay can be adjusted before, during, and/or after the testing. However if a function control is only possible with a closed cap because otherwise the comb is not held or guided, then the engagement in the relay based on the measurement data obtained in the testing is significantly more difficult.

The necessary insulation between the conductive parts on the one side of the partition and the conductive parts in the half on the other side of the partition can be achieved by virtue of the fact that on the end face of the partition remote from the control side, the cap and carrier part engage in each other with groove and rib. This makes it possible to embody the relay as somewhat shorter than the second version.

A second and simpler version, however, is to embody at least one end wall, which is aligned perpendicular to the partition and parallel to the contact springs, on the carrier part, on the end of the partition remote from the control side.

BRIEF DESCRIPTION OF THE DRAWINGS

The foregoing and other features of the present invention will become apparent to those skilled in the art upon reading the following description of preferred embodiments of the invention in conjunction with the accompanying drawings, wherein like elements have been designated by like reference numerals, and wherein.

DETAILED DESCRIPTION OF THE PREFERRED EMBODIMENTS

Figure 1:
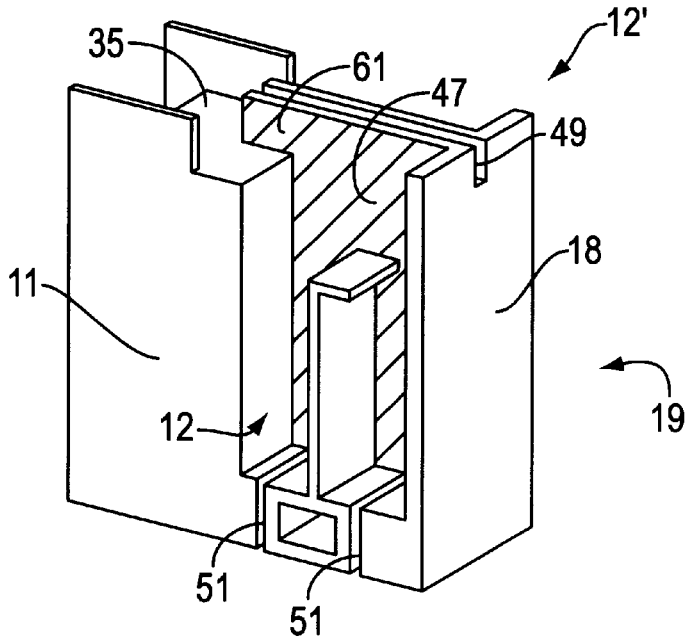
FIG. 1 is a schematic, perspective diagram of the carrier part of a relay according to an exemplary embodiment of the invention, with two contact pairs.
Figure 2:
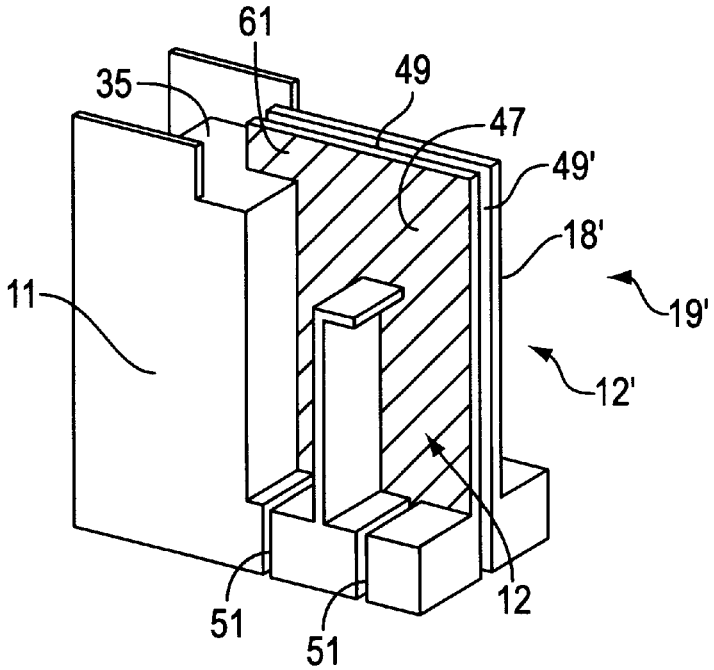
FIG. 2 is a schematic, perspective diagram of exactly the same relay in which the labyrinthine elongation of the air and leakage paths along two edges of the partition is embodied by means of a groove and a rib.

The exemplary embodiments 19, 19' of the carrier part of a relay according to the invention, which are shown in a simplified form in FIGS. 1 and 2, clearly demonstrate several features that cannot be seen well in the other depictions, but are important for the comprehension of the invention. The coil body 11 on the control side of the relay is constituted by a magnet coil that is cast integrally with a yoke and core. Adjacent to the coil body 11, a partition 47 divides the output side into two halves 12 and 12'. The partition 47 adjoins tie coil body 11, protrudes from the coil body and extends into the guide region 35 of the coil body 11 for the comb, not shown. The contact spring, which is disposed closest to the coil body and is not shown, is disposed at a distance from the coil body 11 that is just enough for the adjustment of the contact spring. In actual use, approx. 0.4 to 0.7 mm are required for this. The clamping groove 51 for the contact spring is disposed correspondingly close to the coil body 11.

Thanks to the overlapping part 61 of the partition 47 in the region of the comb guide 35, the distance between the contact springs disposed closest to the coil body 11 in the half 12 and in the half 12' is enough to assure a double insulation. The insulation of the one half 12 from the other 12' does not require any elongation of the carrier part 19. In the guide region 35, the part 61 of the partition 47 can reach practically half the distance to the armature side by way of the coil body 11. Therefore the leakage and air path between the two halves 12, 12' is defined by the outer dimensions of the coil body 11 and not by the distance between the coil body 11 and the contact springs.

The versions of the carrier part 19 and 19' differ in the embodiment of the elongation of the air and leakage paths between the two halves 12, 12' of the end of the partition 47 remote from the coil body 11. In FIG. 1, the partition 47 ends on this side in a wall 18 that is perpendicular to it. This wall 18 is used as a labeling surface for tie relay. Since the cap that is placed over it is transparent, the labeling is protected and legible. The length of the relay, however, can be shortened somewhat further by providing teeth to the cap and partition on the end of the partition remote from the coil. To that end, the groove 49 is not only embodied in the comb side of the partition, but also in the perpendicularly adjoining end edge 18' of the partition 47. The cap is then provided on this side with a rib 71' according to FIG. 13.

Figure 3:
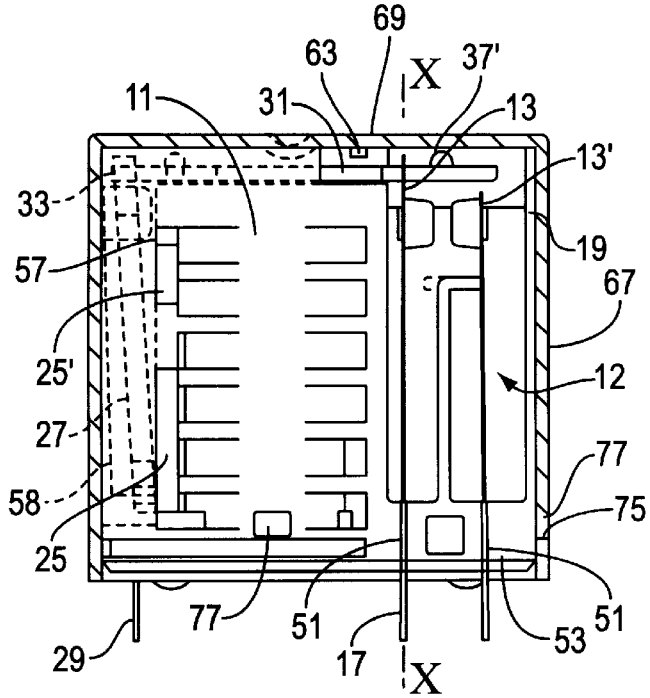
FIG. 3 is a side view of a print relay according to FIG. 1, completely equipped and with a cap.
Figure 4:
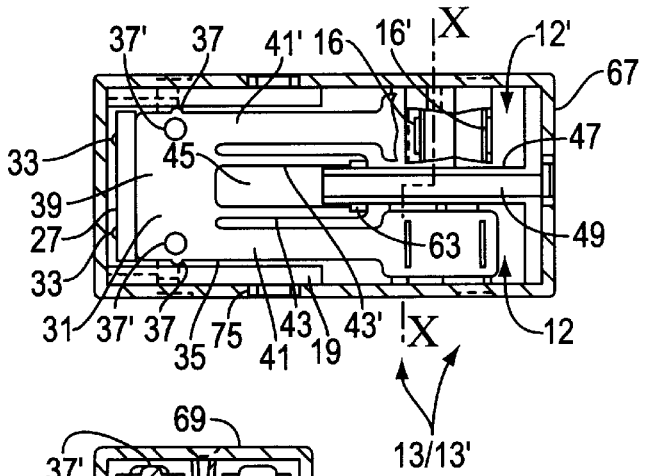
FIG. 4 is a top view of the print relay according to FIG. 3.
Figure 5:
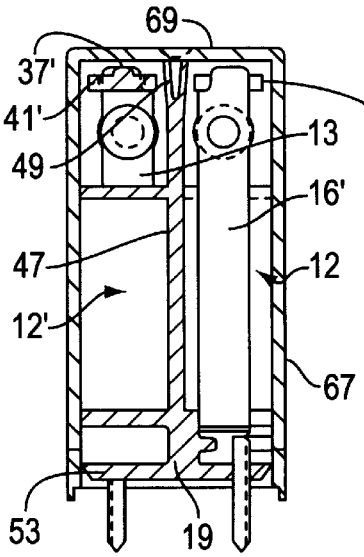
FIG. 5 is a vertical section along the line X—X through the contact pairs of the relay according to FIGS. 3 and 4.

FIGS. 3 to 5 show a relay according to an exemplary embodiment of the invention, with a contact spring pair 13/13', 16/16' in each half 12, 12' of the output side. The difference from the four-contact relay described in the subsequent FIGS. is comprised merely in that the relay has two contacts. Six-contact relays or larger ones can also be produced in an analogous manner. The two-contact relay has outer dimensions of 27.4×12.5×26.2 mm. Like the longer four-contact relay, it is EEx insulated between the control side and the output side and is double insulated between the output contacts 13/13' and 16/16' on the two sides of the partition 47. The individual parts are named in accordance with the parts in FIGS. 6 to 19.

Therefore with the exception of the differences required by the different number of contacts, the following description of the four-contact relay also applies to the two-contact relay.

Figure 6:
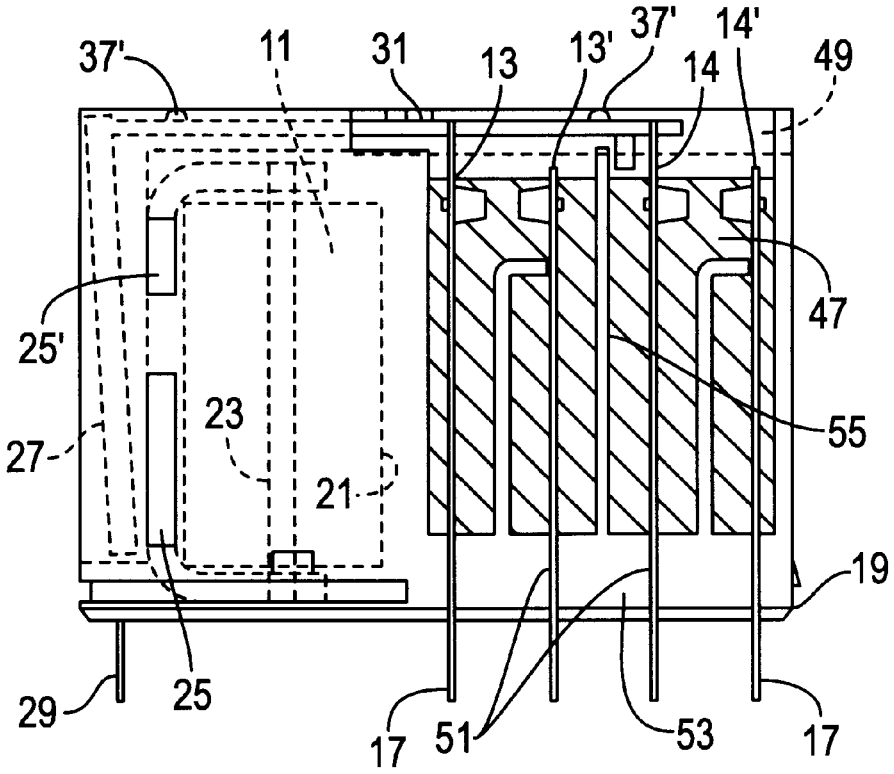
FIG. 6 is a side view of a four-contact print relay according to an exemplary embodiment of the invention, without a cap.
Figure 7:
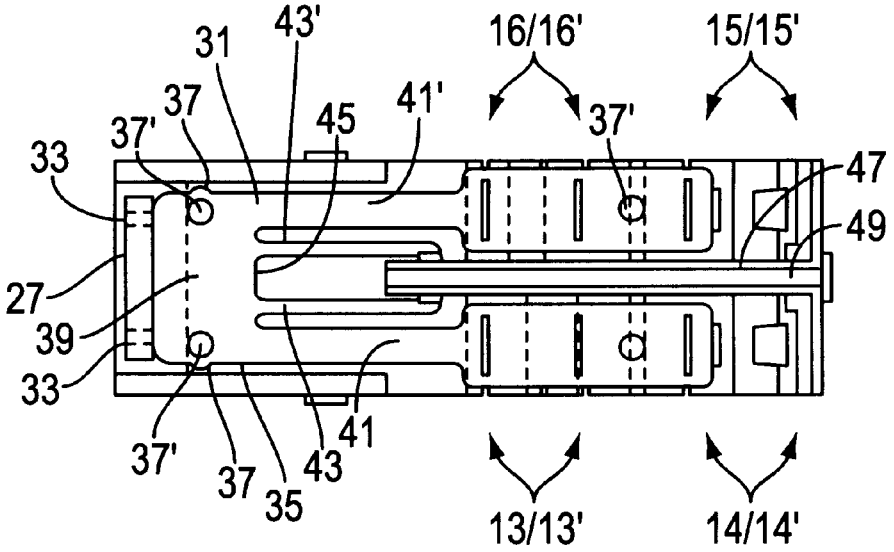
FIG. 7 is a top view of the relay according to FIG. 6.

In the exemplary embodiment of the invention that is shown in FIGS. 6 and 7, four contact units with two contact springs each 13/13', 14/14', 15/15', 16/16' are disposed on the output side. Each contact unit has a long contact spring 13, 14, 15, 16 and a short contact spring 13', 14', 15', 16'. These eight contact springs are each associated with a plug connector 17. On the control side, a coil 21, with the core 23 and the two yoke parts 25, 25' are cast integrally into the carrier part 19. All four are shown with dashed lines in FIG. 6, wherein the two yoke parts 25, 25' reach part way through the plastic extrusion coating of the carrier part 19 and are shown there with solid lines. In addition, the movable armature 27 (also shown with dashed lines in FIG. 6) and the plug connections or connector plugs 29 for the coil 21 are disposed on the control side.

The connection between the armature 27 and the switched contact springs 13, 14, 15, 16 takes place via a comb 31. At the locations 33, the comb 31 slides with two bolts 87 (FIGS. 18 & 19) into two holes in the armature 27. On one side of the coil body 11, the comb is disposed in the U-shaped guide 35. On the one side, the comb 31 is disposed with the bolts in the holes in the armature 27 and on the other side, it rests against the contact springs 13, 14, 15, 16. The contact springs have a recess 80 (FIG. 14) for this. On the side and toward the cap 67 (not shown in FIGS. 6 and 7), spacer nubs 37 and 37' are provided on the comb 31. On the armature end, the comb 31 has a bridge part 39. Two arms 41, 41' and two spring members 43, 43' extend from this bridge part 39 toward the output side. Between the spring members, a recess 45 is provided which guides the movement of the comb 31 along the side wall 47 on both sides. A groove 49 is embodied in the partition 47. On the one side, this groove 49 ends at the coil body 11 and on the other side, ends at the output end of the carrier part 19, wherein it is open at both ends.

In the carrier part 19, clamping grooves 51 are embodied in a base part 53, on both sides of the partition 47. The contact springs are slid into the clamping grooves 51 and are fixed in them. Intermediary walls 55 are provided between the contact units 13/13' and 14/14', as well as 15/15' and 16/16' in order to elongate air and leakage paths.

Figure 8:
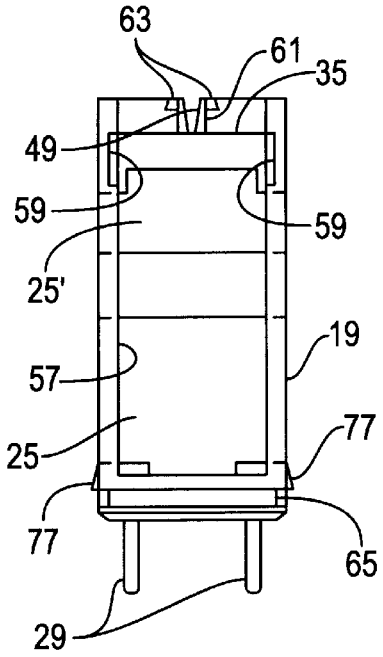
FIG. 8 is a view of the armature side of the relay according to FIGS. 6 and 7, but without the parts to be inserted into the carrier part.
Figure 9A:
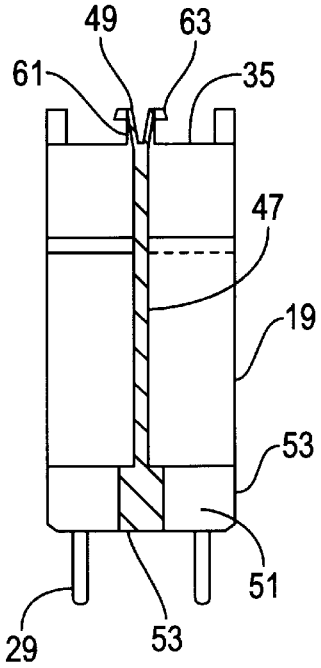
FIG. 9*a* is a cross section through the carrier part of the relay according to FIGS. 6 to 8.

In FIGS. 8 and 9*a,* the carrier part 19 is shown empty. FIG. 8 shows the end face toward the armature. At the bottom, the two control side plug connectors 29 for the coil 21 are shown, which are cast integrally into the carrier part 19. On the surface of the carrier part 19, only the two yoke parts 25, 25' are visible as metal surfaces. A niche 57 for the armature is embodied in the carrier part. The armature is secured in the niche 57 with an armature holding spring 58 (FIG. 3). The armature holding spring 58 is disposed in both recesses 59 against the niche sides.

The niche 57 transitions at right angles into the guide 35. An extension 61 of the partition 47 is disposed in the center of the guide. Projections 63 are embodied on the extension 61, which cooperate with the spring members 43, 43' on the comb 31 and secure the comb 31 in the guide 35.

On the control end, a groove 65 is embodied at the bottom, around the carrier part 19, in order to constitute a catch space between the cap and the carrier part 19 as a capillary stop for liquid or other contaminants that get inside.

Figure 9B:
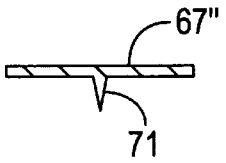
FIG. 9*b* is a cross section through a covering part with a rib.

FIG. 9*b* shows a cross section through a covering part 67" that is disposed under a cap without ribs 71. The covering part 67" can be put in place independently of the cap. In a further modification of the invention, this makes it possible to place the cap over the carrier part 19 from a side other than the comb side. This permits the plug connectors to come out on one of the two largest side faces of the relay. To that end, the connecting pins 17 must be guided from one side 12 of the relay through the partition 47, through the other half 12', and through a separate base part. In the other half 12', the conductive part of different sides are protected by means of reciprocally engaging projections on the carrier part 19 and on the separate base part that is disposed parallel to the partition. So that the connecting pins are spaced far enough apart from each other, the pins of the underside 12' must be offset toward the center of the contact springs and be disposed between the contact springs.

Figure 10:
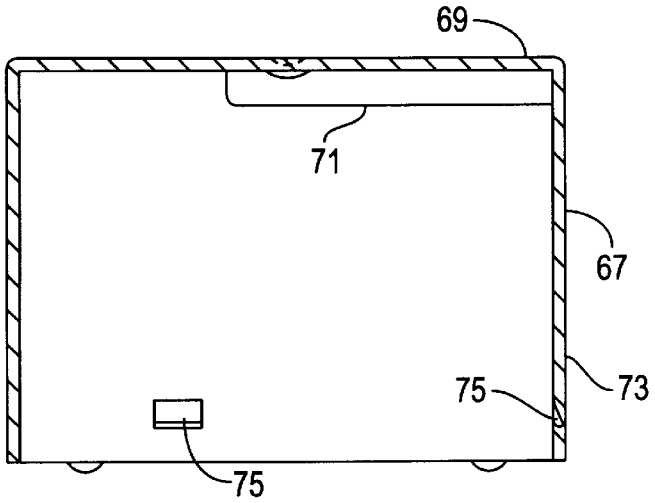
FIG. 10 is a longitudinal section through the cap for the relay according to FIGS. 6 to 9*a*.
Figure 11:
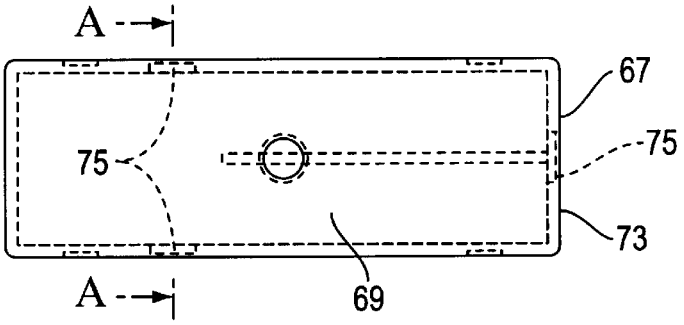
FIG. 11 is a top view of the cap according to FIG. 10.
Figure 12:
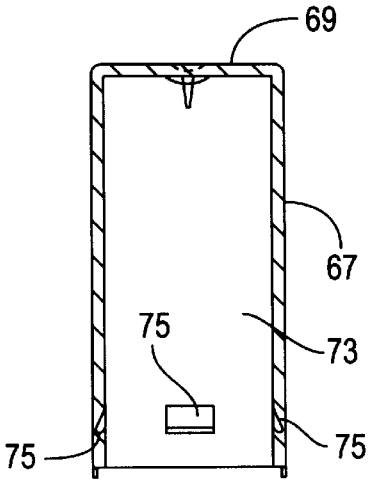
FIG. 12 is a cross section along the line A—A through the cap according to FIGS. 10 and 11.

FIGS. 10 to 12 show the cap 67. The cap 67 substantially encloses (e.g., entirely encompasses or nearly entirely encompasses) the carrier part 19, together with all of the parts disposed on and in it, on five sides. It is slid from the comb side over the carrier part and closes relatively tightly around the base part 53 and the groove 65. When in place, the cap 67 secures the armature holding spring 58 in its place and definitively prevents the comb 31 from being able to spring back out of the guide 35. The nubs 37' touch against the top side 69 of the cap 67 from the inside. A rib 71 is embodied on the top side 69 and passes into the groove 49 in the partition 47. The rib 71 is exactly as long as the groove 49 and is connected to the end wall 73 of the cap 67. Three recesses 75 are provided in the cap 67, which cooperate with the projections 77 on the carrier part in order to secure the cap 67 on the carrier part 19.

Figure 13:
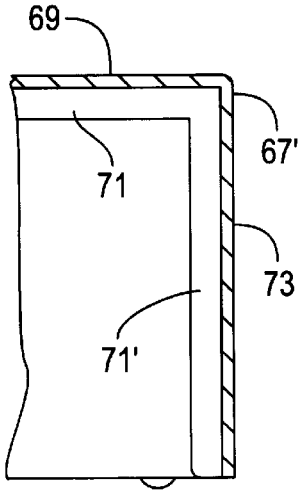
FIG. 13 is a detail from a longitudinal section through the cap of a relay according to FIG. 2.

FIG. 13 shows a detail of the cap 67'. The cap 67' is equipped with a rib 71' on the end wall 73. This rib 71' passes into the groove 49' on the carrier part 19' according to FIG. 2.

Figure 14:
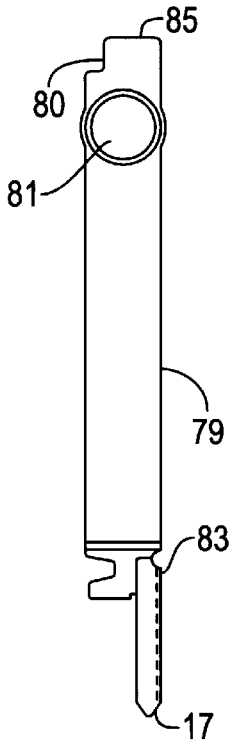
FIG. 14 is a view of a long contact spring for the relay, which spring can be moved by the comb.
Figure 15:
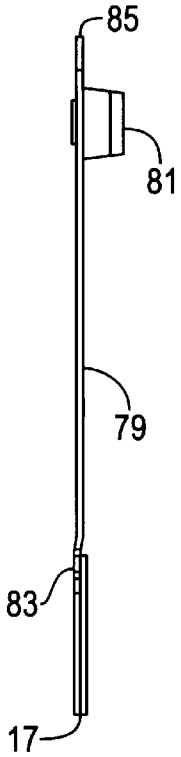
FIG. 15 is a side view of the contact spring according to FIG. 14.
Figure 16:
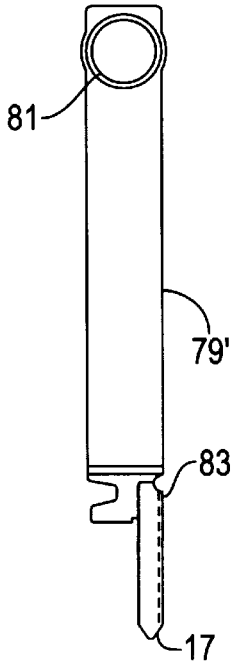
FIG. 16 is a view of a short contact spring for the relay.
Figure 17:
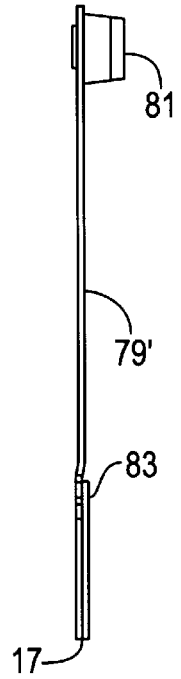
FIG. 17 is a side view of the contact spring according to FIG. 16.

The contact springs 15 in FIGS. 14 and 15 and the contact springs 13', 14', 16' in FIGS. 16 and 17 are each comprised of a flat-surfaced spring plate 79, 79' and a contact head 81 riveted to it. The pin or plug connector 17 is produced of one piece with the spring plate 79, 79' by virtue of the fact that the plate 79, 79' is folded and pressed in the region of the pin 17. In order to obtain the differently oriented contact springs 13, 14, 16, or 15', the contact head 81 merely has to be riveted into the spring plate 79 or 79' from the other side. So that the geometry of differently oriented contact springs, e.g. the contact springs 15 and 16, is the same for the insertion into the clamping grooves 51, the base region 83 of the spring plates 79, 79' that is clamped in the clamping groove 51 when the relay is finished is crimped by half the material thickness of the spring plate. As a result, the spring plate 79, 79' and the pin 17 are axially aligned so that the spring plate can be equipped with the contact head 81 from both the one side and the other side. The small crimp in the material of the spring plate 79 permits an uncrimped axis, in other words a geometrically flat-surfaced embodiment of the plate. Therefore, despite the fact that the pin 17 is embodied on one side and that longer and shorter contact spring plates 79, 79' are required, only two different contact spring plates 79 and 79' have to be produced.

The spring plates 79 are only slightly longer than the spring plates 79'. They have a recess 80 at the upper end. In other words, they have an upper elongation 85 above the contact head 81, which is narrower than the spring plate 79 by the size of the recess 80. With this extension 85, the spring plate engages with the comb 31. The extension can be narrower than the other spring plate since it does not have to conduct any current and does not have to be resilient. Thanks to the narrower embodiment of the elongation 85 in relation to the other spring plate 79, the comb can be placed on the spring plate and the space gained can be used for the rib 71, the partition 47, the comb 31, and the intermediary space between the partition and the comb. As a result, the depth of the relay can be reduced.

Figure 18:
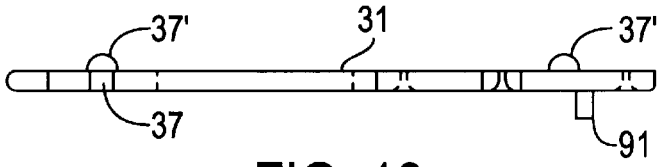
FIG. 18 is a side view of the comb.
Figure 19:
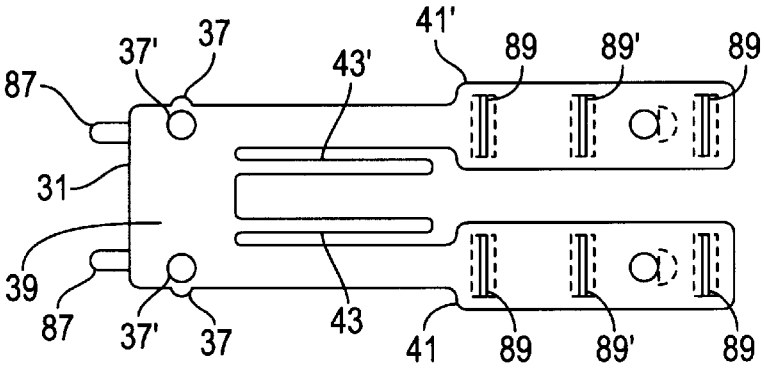
FIG. 19 is a top view of the comb according to FIG. 18, and finally.
Figure 20:
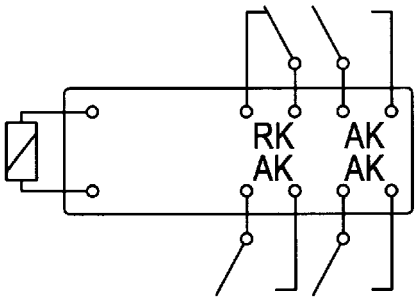
FIGS. 20 & 21 show two wiring diagrams of a four-contact relay.
Figure 21:
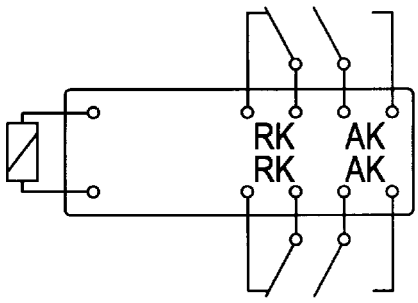

FIGS. 18 and 19 show the comb 31 with the two arms 41, 41' and the spring members 43, 43' on the bridge part 39. The nubs 87 are disposed in the armature 27. The spring members 43, 43' guide the comb along the partition 47 and are secured in the guide 35 by the projections 63. The two arms 41, 41' are provided with identical slot devices. The slots 89 are for the moved contact springs of contacts that are closed when the magnet coil is activated (AK) (e.g. 13/13', 14/14', 15/15'), the slots 89' are for those which are simultaneously opened (RK) (e.g. 16/16'). Depending on the desired embodiment, only one or both of the slots 89' engage with a long contact spring plate 79. FIGS. 20 and 21 show two possible wiring diagrams of the relay. With the comb 31 pictured, the mirror image of the asymmetrical upper wiring diagram is also possible. A stop 91 is embodied on the underside of the comb 31; this stop cooperates with the intermediary wall 55 and limits the movement of the comb 31 and thereby of the contact springs 13, 14, 15, 16.

In a two-contact relay, the comb 31' has only the first four slits 89, 89'. The slits 89 on the end, together with the corresponding piece of the arm 41, 41', are eliminated. The possible wiring diagrams therefore correspond to those of the contacts that are close to the coil body in the four-contact relay.

The four-contact relay shown in the FIGS. has outer dimensions of approx. 36.1×12.5×26.2 mm. In the relay, whether it has two contacts or a number of them, there is a distance of over 15 mm between the plug connectors 29 or 17 on the control side and those on the output or load side. The plug spacings between the output side plugs 17 from center to center are 5 mm between the contacts on one side of the partition and 7.5 mm between the contacts on different sides of the partition 47. On the inside, the distances are at least 8 mm between the contacts on different sides of the partition and are at least 10 mm between the electrically conductive parts of the control side and the load contacts of the output side. The contacts (e.g. 15/15' and 16/16') on one side of the partition 47 can be configured as control contacts and the contacts (e.g. 13/13', 14/14') on the other side of the partition 47 can be configured as load contacts and in this connection, they are insulated in relation to each other in a doubled or increased fashion.

In conclusion, it can be said that in a relay for explosion endangered regions, the coil 21, core 23, and yoke 25, 25' are cast integrally into the carrier part 19. At least one contact unit 13/13', 14/14', or 15/15', 16/16' is respectively disposed on both sides of a partition 47 that is disposed on the carrier part 19 and adjoins the coil body 11. The armature 27 is disposed on the side of the coil 21 remote from the contacts. A comb 31 connects the armature 27 on the one side of the insulated coil with the movable contact springs 13, 14, 15, 16 on the other side. In the region in which the comb 31 passes by the coil 21, a guide 35 for the comb 31 is embodied on the carrier part 19. The partition 47 has an extension 61 which reaches into this guide region 35 next to the coil 21. This extension 61 and the partition 47 are provided with a groove 49 into which a rib on the cap that covers the relay protrudes in order to lengthen the air and leakage path from one side of the partition 47 to the other. Air and leakage paths of at least 10 mm are mailed between the contacts and the electrically conductive parts of the magnetic circuit. Doubled or increased air and leakage paths of at least 8 mm are provided between the contacts on the one side of the partition 47 and the contacts on the other side.

It will be appreciated by those skilled in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. A safety relay for network voltage, comprising:

restricted guidance contacts and an insulation between a control side and an output side sufficient for explosion endangered regions;

a carrier part for the control side and output side;

a cap which substantially encompasses the carrier part;

a fixed coil body;

a movable armature disposed on a side of the coil body remote from the output side;

plug connectors on the control side;

a magnet coil of the coil body which, together with a core and yoke, is extrusion coated with plastic to be insulated on all sides except for parts of the yoke;

a comb that is conveyed past a surface of the coil body to transmit movements of the armature to the output side;

a partition that adjoins the coil body perpendicularly and divides the output side into two halves, wherein on each side of the partition, at least one output contact comprised of at least two contact springs connected to output side connector plugs is provided, said partition protruding from the coil body on the comb side; and a first arm of the comb on the one side of the partition, and a second arm on another side of the comb that is separated from the first arm by the partition, for the restricted guidance of the contact springs, the arms having openings directed perpendicular to a movement direction of the comb, and the contact springs being movable with the comb engaging in these openings, wherein:

the contact springs are flat-surfaced, and contact springs disposed closest to the control side are disposed with a minimal distance from the coil body that is sufficient for their adjustment and functioning; and a part of the partition that protrudes from the coil body on the comb side reaches to the control side along the comb side surface of the coil body, so that its armature end has a distance from the contact springs disposed closest to the coil body that is greater than the distance between the coil body and the contact springs disposed closest to it, to assure an air and leakage path between the two contact springs disposed closest to the coil body for protection against dangerous body currents.

2. The safety relay according to claim 1, wherein at least one of the cap and a separate cover part, which is disposed on the outside of the comb, and the partition engage in each other with a rib and a groove over the entire comb side length of the partition.

3. The safety relay according to claim 1, wherein the core of the magnet coil is aligned parallel to the contact springs.

4. The safety relay according to claim 1, wherein the carrier part is an injection molded part that is cast in one piece with the extrusion coating of the magnet coil.

5. The safety relay according to claim 1, wherein in a base region of the contact springs, the carrier part has clamping grooves aligned perpendicular to the movement direction of the comb, into which the contact springs can be slid in a direction perpendicular to the plane of a partition.

6. The safety relay according to claim 1, with a number of output contacts in one half, wherein intermediary walls are embodied on the carrier part, perpendicular to the partition and between the output contacts in the same half, and these intermediary walls elongate the air and leakage paths between the adjoining contact springs.

7. The safety relay according to claim 1, wherein projections that are disposed opposite each other are embodied on both sides of the partition, on the side of the comb remote from the relay, wherein a distance between a projection tips is greater than a width of an intermediary space between the two arms of the comb.

8. The safety relay according to claim 7, wherein two spring members that cooperate with the projections are embodied on the comb.

9. The safety relay according to claim 2, wherein the cap and the carrier part engage with each other with groove and rib on an end face of the partition remote from the control side.

10. The safety relay according to claim 2, wherein at least one end wall that is aligned perpendicular to the partition and parallel to the contact springs is embodied on the carrier part, on the end of the partition remote from the control side.

11. The safety relay according to claim 1, wherein the safety relay is a print relay.

12. A safety relay for network voltage, comprising:

a carrier part made of electrically insulating plastic material;

a cap which substantially encompasses the carrier part, the carrier part forming a control side with a coil body carrying a magnetic coil and an output side carrying output contacts comprised of at least two flat-surfaced contact springs, the contact springs being connected to connector plugs placed on the output side, the carrier part providing a leakage path length on the inside of the relay between electrically conductive parts on the control side and electrically conductive parts on the output side;

a plane partition that adjoins the coil body perpendicularly and divides the output side into two halves, wherein on each side of the partition, there is at least one output contact, the partition insuring a length of air and leakage path between the output contacts on one side of the partition and the output contacts on the other side of the partition for protection against dangerous body currents;

the magnetic coil being connected to connector plugs placed on the control side and connected with the magnetic coil which, together with a core and yoke, is extrusion coated to be insulated on all sides except for parts of the yoke;

a movable armature disposed on a side of the coil body remote from the output side;

a comb that is conveyed past a comb side surface of the coil body to transmit movements of the armature to the contact springs on the output side; and a first arm of the comb on one side of the partition, a second arm of the comb on the other side of the partition, the partition protruding from the coil body on the comb side surface of the coil body, thus separating the two arms, the arms having openings directed perpendicular to the movement direction of the comb for restricted guidance of the contact springs, and the contact springs being movable together with the comb engaging in these openings;

wherein:

a part of the partition that protrudes from the coil body on the comb side surface has an armature end that extends to the control side along the comb side surface of the coil body; and a distance between the armature end of the partition and the contact spring disposed closest to the coil body being greater than the distance between the coil body and said contact spring thus allowing the contact spring disposed closest to the coil body to be disposed in a distance from the coil body essentially smaller than half of a distance set for air and leakage paths between the electrically conductive parts on one side of the partition and electrically conductive parts on the other side of the partition.

13. The safety relay according to claim 12, wherein at least one of the cap and a separate cover part, which is disposed outside of the comb, and the partition engage in each other with a rib and a groove over an entire comb side length of the partition.

14. The safety relay according to claim 12, wherein the core of the magnetic coil is aligned parallel to the contact springs.

15. The safety relay according to claim 12, wherein the carrier part is an injection molded part that is cast in one piece with the extrusion coating of the magnetic coil.

16. The safety relay according to claim 12, wherein in a base region of the contact springs, the carrier part has clamping grooves aligned perpendicular to a movement direction of the comb, into which the contact springs can be slid in a direction perpendicular to the plane of a partition.

17. The safety relay according to claim 12, with a number of output contacts in one half, wherein intermediary walls are embodied on the carrier part, perpendicular to the partition and between the output contacts in the one half, and these intermediary walls elongate the air and leakage paths between adjoining ones of the contact springs.

18. The safety relay according to claim 12, wherein projections that are disposed opposite each other are embodied on both sides of the partition, on a side of the comb, wherein a distance between tips of the projections is greater than a width of an intermediary space between the two arms of the comb.

19. The safety relay according to claim 18, wherein two spring members that cooperate with the projections are embodied on the comb.

20. The safety relay according to claim 13, wherein the cap and the carrier part engage with each other with the groove and rib on an end face of the partition remote from the control side.

21. The safety relay according to claim 13, wherein at least one end wall that is aligned perpendicular to the partition and parallel to the contact springs is embodied on the carrier part, on an end of the partition remote from the control side.

22. The safety relay according to claim 12, wherein the safety relay is a print relay.

* * * * *